US006902122B2

(12) United States Patent
Boersen et al.

(10) Patent No.: US 6,902,122 B2
(45) Date of Patent: Jun. 7, 2005

(54) DEVICE FOR ATOMIZING A LIQUID PRODUCT, A SPRAY-DRYING AND CONDITIONING DEVICE PROVIDED THEREWITH, AND A METHOD FOR CONDITIONING A LIQUID PRODUCT

(75) Inventors: Antonius Cornelis Boersen, Noordwolde (NL); Willem Marten Friso, Haskerdijken (NL)

(73) Assignee: Carlisle Friesland B.V., Gorredijk (NL)

( * ) Notice: Subject to any disclaimer, the term of this patent is extended or adjusted under 35 U.S.C. 154(b) by 0 days.

(21) Appl. No.: 10/173,713

(22) Filed: Jun. 19, 2002

(65) Prior Publication Data

US 2002/0175225 A1 Nov. 28, 2002

Related U.S. Application Data

(63) Continuation of application No. PCT/NL00/00931, filed on Dec. 20, 2000.

(30) Foreign Application Priority Data

Dec. 20, 1999 (NL) ..... 1013893

(51) Int. Cl.[7] ..... B05B 7/06

(52) U.S. Cl. ..... 239/424; 239/403; 239/406; 239/433; 239/453; 239/506; 239/514; 239/521

(58) Field of Search ..... 239/8, 13, 128, 239/135, 403, 405, 406, 418, 429, 433, 424, 424.5, 425, 451, 453, 505, 513, 514, 518, 521, 523, 524, 533.1, 533.15, 506, 533.7

(56) References Cited

U.S. PATENT DOCUMENTS 1,002,594 A * 9/1911 Mason et al. ..... 239/424
3,095,153 A * 6/1963 Soth ..... 239/405
4,592,506 A * 6/1986 Capes et al. ..... 239/424
4,728,036 A * 3/1988 Bennett et al. ..... 239/433

FOREIGN PATENT DOCUMENTS

| | | | |
|---|---|---|---|
| BE | 445 624 | A | 6/1942 |
| DE | 37 24234 | A1 | 2/1989 |
| DE | 42 13518 | A1 | 10/1989 |
| FR | 2 052 003 | A | 4/1971 |
| GB | 203794 | A | 9/1923 |
| GB | 1 320 016 | | 7/1970 |
| GB | 2 326 116 | A | 12/1998 |

* cited by examiner

*Primary Examiner*—Steven J. Ganey
(74) *Attorney, Agent, or Firm*—Browdy and Neimark, P.L.L.C.

(57) ABSTRACT

The invention relates to a device for atomizing a liquid, thereby forming a hollow cone of liquid, comprising a housing into which a first liquid product can be supplied, said housing comprising an outflow end and an insert piece with a guide end that interacts with the outflow end, thereby forming an annular outflow gap, wherein the housing is accommodated in the bottom of a hollow casing; and wherein apertures are present in the bottom, while a second medium can be supplied into the hollow casing, flow out of the apertures and interact with the hollow cone.

The invention also relates to a spray drier, with a device according to the invention, to a device for conditioning a liquid product using the invention, and a method for conditioning a liquid product, using a device according to the invention.

6 Claims, 6 Drawing Sheets

DEVICE FOR ATOMIZING A LIQUID PRODUCT, A SPRAY-DRYING AND CONDITIONING DEVICE PROVIDED THEREWITH, AND A METHOD FOR CONDITIONING A LIQUID PRODUCT

CROSS-REFERENCE TO RELATED APPLICATIONS

This is a continuation application of PCT/NL00/00931, filed Dec. 20, 2000, which PCT-application claims priority of Dutch patent application number 1013893 filed Dec. 20, 1999, herein incorporated by reference.

FIELD OF THE INVENTION

The invention relates to a device for atomizing a liquid product, at least comprising a housing into which a first medium in the form of a liquid product for atomization can be supplied, said housing having an outflow end and an insert piece with a guide end that interacts with the outflow end of the housing, thereby forming an annular outflow gap.

BACKGROUND OF THE INVENTION

Such devices are generally known, and in the article "Zerstauben von Flussigkeiten" [atomization of liquids] by Peter Walzel in Chem. Ing. Tech. 62 (1990), No. 12, pp. 983–994 such a device, called an annular gap nozzle, is described on page 986.

A hollow cone-shaped stream of liquid droplets is generally obtained with such a device, which droplets when delivered into the drying chamber of, for example, a spray drier can be subjected to a drying operation, thereby forming a manageable product that can then, if desired, be subjected to a further treatment inside or outside the spray drier.

A high pressure is usually needed for breaking up the liquid into discrete droplets in the case of such a device and, starting from the known device, applicant has made every effort to improve said device further in such a way that a better division into discrete droplets is obtained, so that the interaction possibilities between such droplets and the drying air are improved, while use of high pressures can be avoided.

SUMMARY OF THE INVENTION

The abovementioned object is achieved according to the invention by the fact that the housing of the device is accommodated in the bottom of a hollow casing; and that at least one aperture is present in the bottom of the hollow casing, to which aperture at least one other medium can be supplied, which medium can flow out of the aperture and interact with the hollow cone of liquid delivered through the outflow gap.

In the above phraseology the term "bottom" is not necessarily a downward directed surface, but is intended to indicate a plane from the surface of which the housing of the device projects outwards.

Designing the device as indicated here according to the invention creates an atomization possibility that, on the one hand, has great flexibility as regards capacity, while on the other hand, making another medium (for example, air) collide with the hollow cone of liquid formed means that very good splitting up of the liquid material into discrete droplets is obtained, with the attendant very good drying possibilities of such droplets.

It is stated that at least one other medium can be supplied, which medium flows out through the aperture or apertures, so that an interaction follows with the hollow cone of liquid delivered through the outflow gap. If more than one other medium is used, it is assumed that these media are supplied separately to an aperture or system of apertures intended for them, unless otherwise stated.

Good results are obtained if one or more collections of several apertures are present in the hollow casing around the device according to the invention and are provided symmetrically around the housing thereof.

In an expedient embodiment the housing is of a circularly symmetric design, while each of the one or more collections of several apertures is provided in a uniformly distributed manner on a circle around the housing.

The abovementioned apertures can, of course, be of many different types and designs, but the apertures are expediently bores.

In a basic embodiment the apertures are bores, while the axis for each of the bores is situated vertically to the bottom of the hollow casing.

In an attractive embodiment the apertures are bores, while the axis of each of the bores forms an angle with the vertical to the bottom of the hollow casing in which the housing of the device is accommodated.

However, it is very advantageous for the vertical to the bottom of the hollow casing and the axis of one of the apertures always to lie in a plane in which a tangent on the abovementioned circle also lies, at the position of the axis of the aperture.

Otherwise, in the device according to the invention, the vertical to the bottom of the hollow casing and the axis of one of the apertures can always lie in a plane that forms an angle with a plane in which said vertical and a tangent on the circle lie, at the position of the axis of an aperture.

Varying the direction of the apertures can produce a greater or lesser influence on the hollow cone of liquid formed by the device according to the invention.

In the device according to the invention relatively low pressure of the liquid first medium will suffice. Owing to the fact that the insert piece has a guide end that is of a cone shape, a liquid film that emerges in hollow cone form is formed between the outflow end and the guide end. Said liquid film can in fact have a closed or substantially closed character.

The break-up of the film into droplets occurs through the action of the other medium or the other media, as the case may be. This design makes it possible to dispense with the use of high pressure for the first medium.

In the last-mentioned embodiment the axes of the apertures, which can be bores, are preferably tangents on a(n) (imaginary) conical surface. The conical surface expediently has an apex angle between 30 and 150 degrees, preferably between 60 and 150 degrees.

More particularly, the apex of the cone in the device is situated on the side at which the first medium is supplied; the flow of the other medium supplied is then directed outwards and is found to be very effective in the breaking up of the film. In addition, the flow of the second medium has a tangential component, which contributes to optimum breaking up of the hollow cone of the first medium.

In a further embodiment, in a collection of apertures (or in each collection) the apertures are combined to form a uniform annular gap (or uniform concentric annular gaps in the case of several collections).

As regards the apertures, it is pointed out that the thickness H of the bottom of the hollow frame with the (hydraulic) diameter and the angle a that the axis of an aperture forms with the horizontal of the bottom has the following relation:

$$H \geq \frac{D}{\cos\alpha}.$$

The direction and size of an aperture are expediently such that in a direction perpendicular to the bottom no direct passage is observed (one cannot look through the bottom with apertures).

The device according to the invention outlined above very advantageously has an outflow gap that is adjustable in size.

In a basic embodiment the insert piece forming part of the device according to the preamble has a fixed position relative to the housing, in which said insert piece is accommodated, thereby forming an annular outflow gap.

However, the insert piece is advantageously disposed so that it is adjustable, in order to form an adjustable annular outflow gap.

In a very attractive embodiment, in the device according to the invention the insert piece is movably disposed relative to the housing, while spring means are present to ensure that if the pressure in the first medium falls to below a predetermined value, the guide end of the insert piece is drawn against the outflow end of the housing, thereby substantially shutting off the outflow end.

The presence of the spring means ensures that if a certain pressure associated with the spring force is exceeded, the insert piece is moved outwards relative to the housing, so that liquid product can flow out through the outflow gap in the form of a hollow cone.

In this embodiment adjusting means are provided so that the maximum size of the outflow gap can be set. It is also pointed out that the part of the device comprising a housing and an adjustable insert piece accommodated therein, in the embodiment with spring means possibly also has independent inventive value, apart from the situation in which said housing is accommodated in a hollow casing.

If the pressure inside the housing falls below a predetermined value that corresponds to the force which is exerted by the pressure and is equal to the force exerted on the insert piece by the spring means, the insert piece will be drawn with its guide end against the outflow end of the housing, thereby substantially shutting off the latter.

The invention also relates to a spray-drying device, at least comprising a chamber, a spray nozzle disposed therein, supply means for supplying a liquid product for atomization to the spray nozzle, and means for discharging spray-dried product, and also treatment and/or post-treatment means disposed inside or outside the drying chamber, in which means a device according to the invention described above is disposed.

The invention further relates to a device for conditioning a liquid product, which device comprises an atomization nozzle for the liquid product, a treatment chamber and an outlet from the treatment chamber, and is characterized in that the atomization nozzle is a device of the type described above according to the invention.

The atomization device present in the conditioning device can comprise apertures for one other medium, but two or more (collections of) apertures are expediently present for supplying two or more different media to a hollow cone of liquid delivered through the outflow gap.

Finally, the invention relates to a method for conditioning a liquid product, in which such a liquid is divided into fine droplets and is brought into contact with one or more other media for supplying heat and/or desired substances, characterized in that said method is carried out using the device according to the invention described above.

In an attractive embodiment the method can be used, for example, for boiling starch by treating a paste thereof with steam and/or air.

The term conditioning as mentioned above should be understood as meaning any treatment serving to bring a liquid product or constituents thereof into a desired state. The treatment can involve the supplying/removal of heat, the supplying/removal of constituents etc. etc.

BRIEF DESCRIPTION OF THE DRAWINGS

The present invention will now be described with reference to the drawing, in which.

DESCRIPTION OF THE PREFERRED EMBODIMENTS

Figure 1:
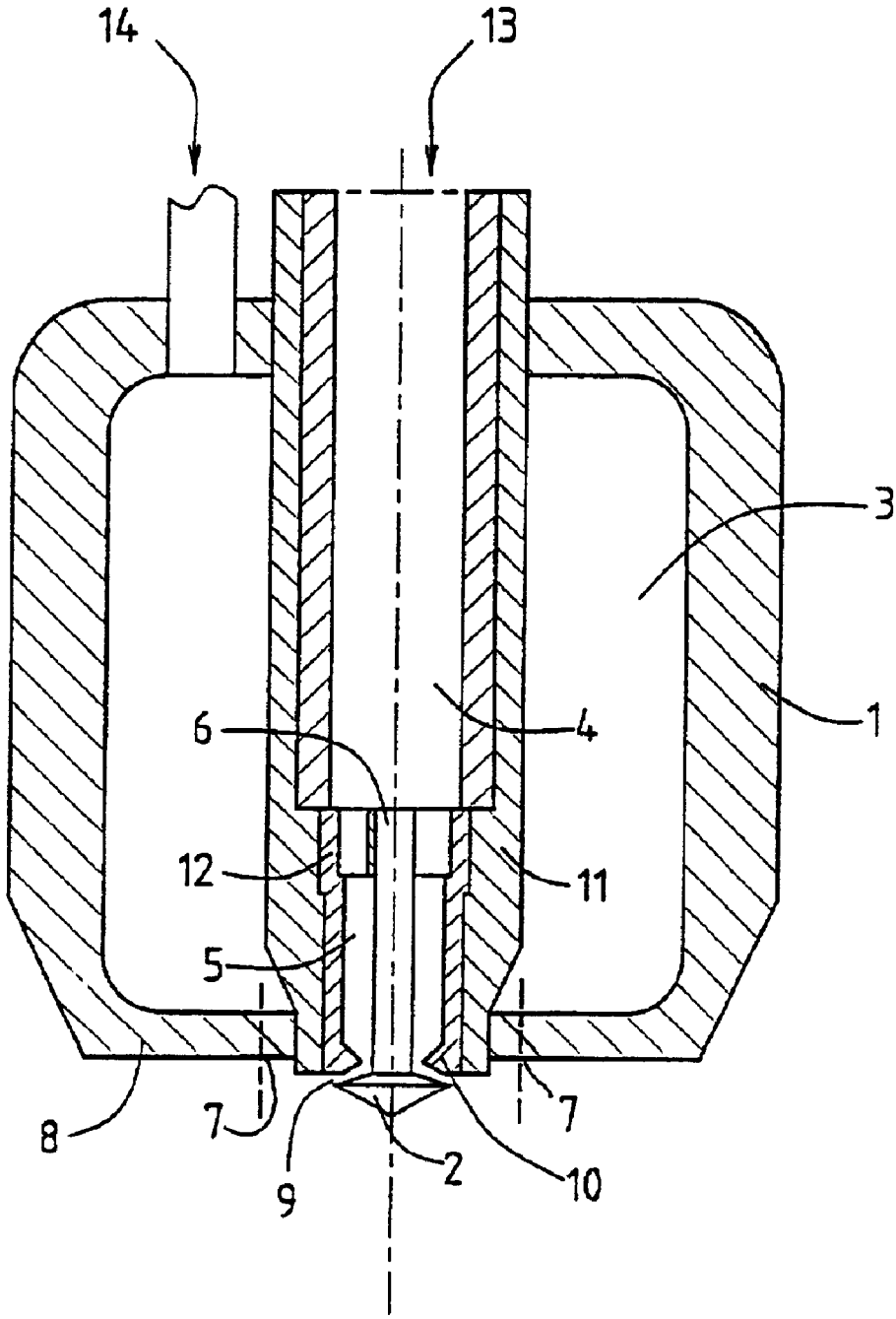
FIG. 1 is a diagrammatic cross-sectional view of the device according to the invention.

FIG. 1 shows a hollow casing 1, accommodating an atomization device according to the invention, which comprises a housing with parts 11, 12 in which an insert piece 6 with a guide end 2 is accommodated. The housing is accommodated in the hollow casing 1 by means of fixing means (not shown in any further detail).

The guide end 2 has a cone shape facing the medium supply inlet, which cone shape has an apex angle between 30 and 150 degrees, this angle expediently being between 90 and 150 degrees. The side of the insert piece facing away from the medium supply is also conical; this shape is useful for preventing caking of atomized and possibly dried product.

A liquid product to be atomized (the first medium) is supplied at 13 and guided through spaces 4 and 5 to the end 10 of the housing 11, 12; the product then goes into the gap—which has a fixed setting here—which is left clear between the guide end 2 and the outflow end 10 of the housing, and then flows out in the form of a hollow cone of liquid.

The cone shape of the part of the insert piece facing the medium supply determines the apex angle of the hollow cone of liquid formed. Even when the first medium is at low pressure, a hollow cone of liquid is obtained, in this case the liquid being able to exhibit only a slight degree of breaking up into individual droplets. When the pressure of the first medium is raised, breaking up into individual droplets will increase. Breaking up is not absolutely essential for the functioning of the device, since the influencing by one or more other media through the specifically chosen directions and flow rates can ensure controlled atomization, as will be described below.

A second medium in the form of gas enters the hollow casing 1 at 14 and by way of the space 3, which medium flows out through the diagrammatically illustrated apertures 7, and the gas stream thus formed interacts with the liquid of the hollow cone delivered by the outflow gap 9 between the outflow end 10 of the housing 11, 12 and the guide end 2 of the insert piece 6.

The apertures 7 are disposed in a circle around the device illustrated here in a circularly symmetric design; the apertures 7 are bores and the axis of the bores lies together with the vertical to the bottom 8 of the hollow casing 1 in a plane in which the tangent on the circle around which the apertures 7 are distributed at regular intervals also lies.

As indicated in the description, the axis of the holes can advantageously also lie in a plane in which the vertical to the bottom 8 is accommodated together with said axis, while the abovementioned plane forms an angle with the plane in which the tangent on the circle and the abovementioned vertical lie.

Depending on the desired splitting-up and drying effect, the person skilled in the art will know how to vary the position, the number, the shape and the size of the holes in order to obtain the optimum result.

Figure 2:
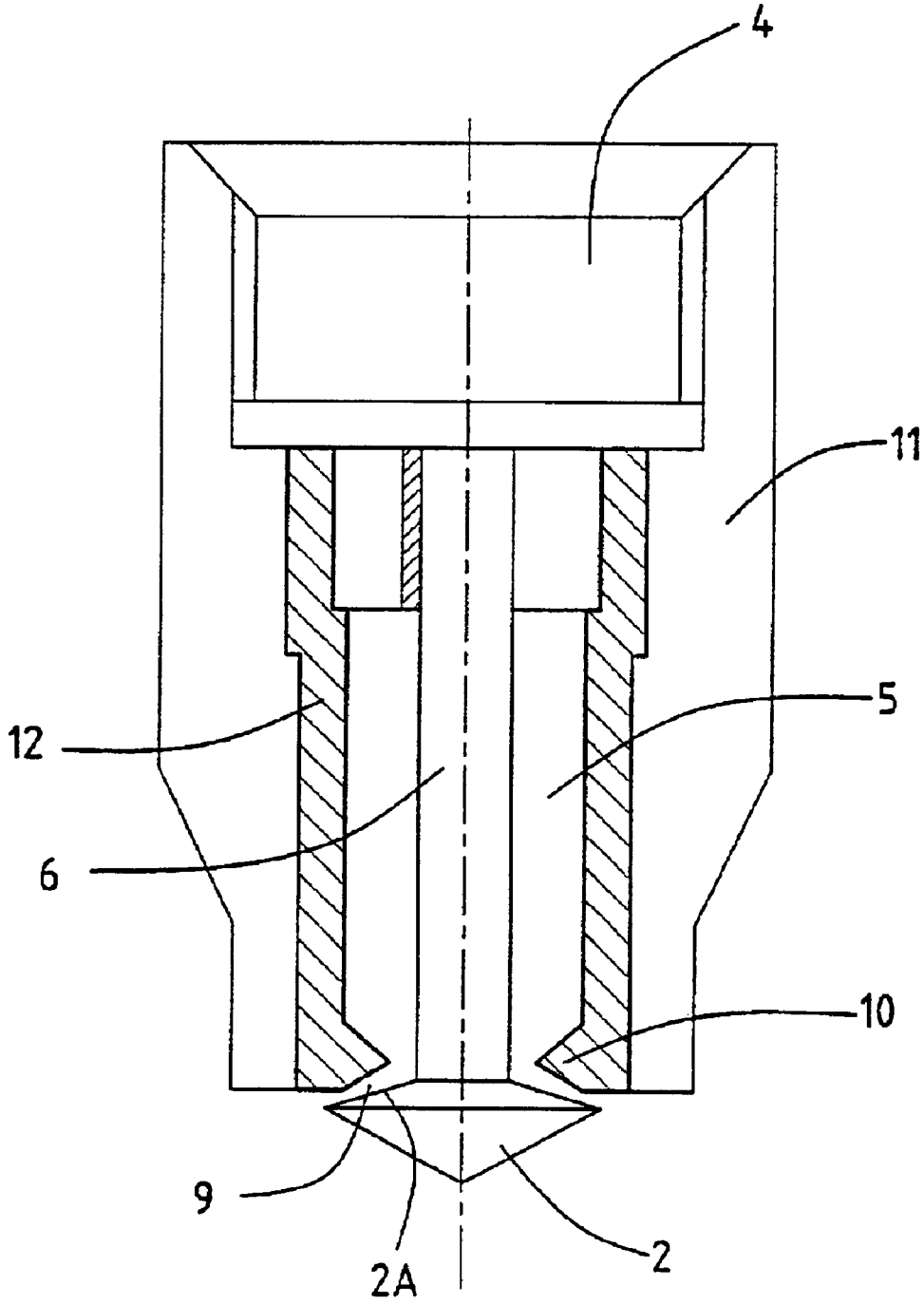
FIG. 2 shows in enlarged detail the housing that forms part of the device according to the invention.

FIG. 2 shows schematically on an enlarged scale the housing 11, 12 from FIG. 1, the same parts being indicated by the same numerals.

The insert piece 6 with the guide end 2 can be seen clearly here; it can also be seen that the outflow gap 9 is of a slightly flared shape, so that the highest pressure of the first medium ultimately lies on the outside of said gap 9.

The apex angle of the hollow cone of liquid first medium is substantially determined by the slope of the part 2A of the guide end 2; the apex angle of the hollow cone will generally have a value between 150° and 60°. Apex angles of less than 60° are possible, but contact of the droplets in the hollow cone with the air emerging from the apertures 7 of the hollow casing 1 is then less effective.

Figure 3B:
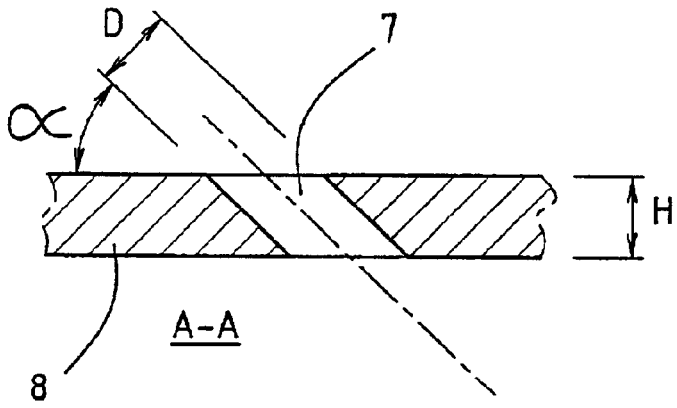
FIG. 3B shows schematically a bore in the bottom of the hollow casing.
Figure 3A:
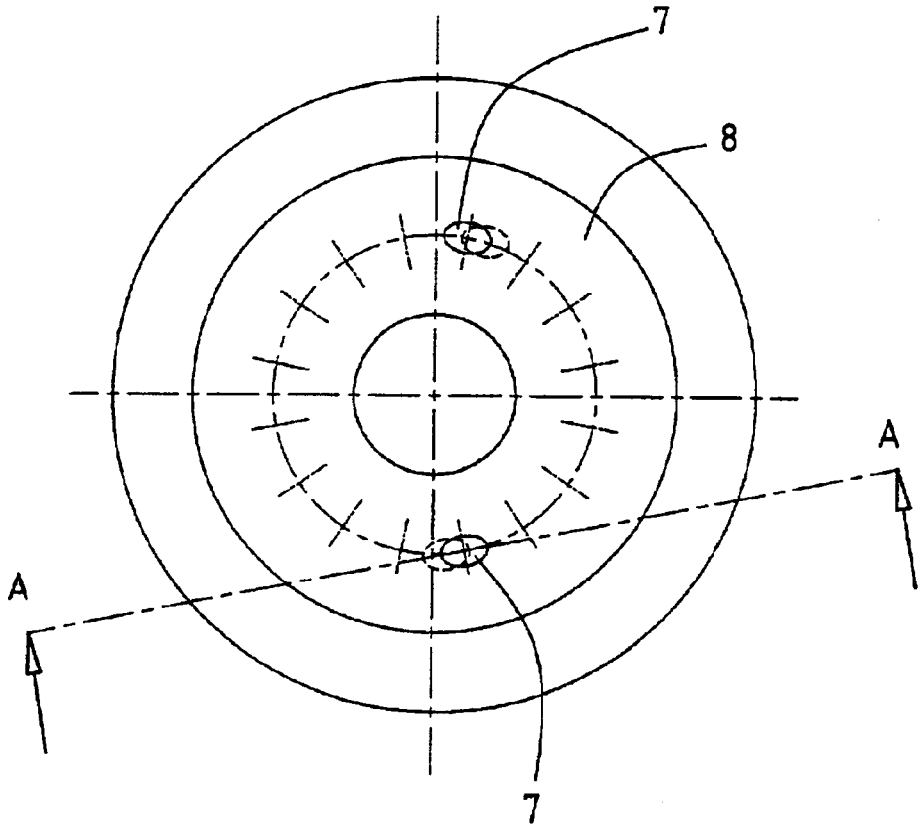
FIG. 3A shows the bottom of a hollow casing in which the device according to the invention is accommodated.

In FIG. 3A the bottom 8 of the hollow casing 1 is visible, with two apertures 7 placed on a circle around the housing of the device. It can be seen in FIG. 3A that the apertures are drilled at an angle with the normal to the bottom 8, in this case the normal to the bottom 8 and the axis of the aperture 7 lying in a plane in which the tangent on the circle shown also lies.

A drilled aperture 7 in the bottom 8 is shown in detail in FIG. 3B, taken along the line A—A in FIG. 3A.

As regards the condition that the apertures are preferably provided in such a way that on looking towards the bottom of the casing in a direction perpendicular to the bottom no direct passage is observed, the following is pointed out.

At a plate thickness H in FIG. 3B, an aperture diameter D and an angle a with the horizontal that condition is met if:

$$H \geq \frac{D}{\cos\alpha}.$$

Figure 4:
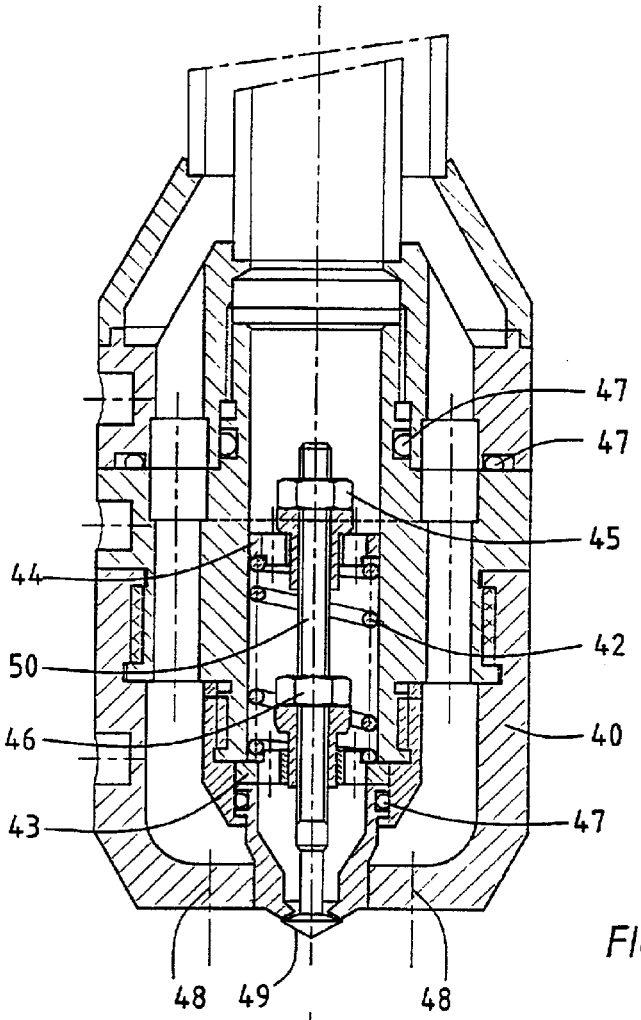
FIG. 4 shows schematically a device provided with spring means for opening the outflow gap depending upon the pressure of the first medium.

FIG. 4 shows the situation in which provisions are present for the outflow gap to be adjustable between the guide end of the insert piece and the outflow end by the presence of spring means.

The device for atomizing a liquid first medium is accommodated in a hollow casing 40. A spring 42 is accommodated between a fixed stop 43 and an adjustable stop 44 around the stem 50 of the insert piece with guide end 49. A nut 46 on the threaded stem 50 provides for the setting of a suitable size of outflow gap, while the nut 45 determines the compression of the spring 42, and thus the pressure above which the gap is opened or below which the gap is closed. Reference numeral 47 indicates a number of sealing rings, which are known per se, and which provide for medium tightness of the atomization device.

Figure 5:
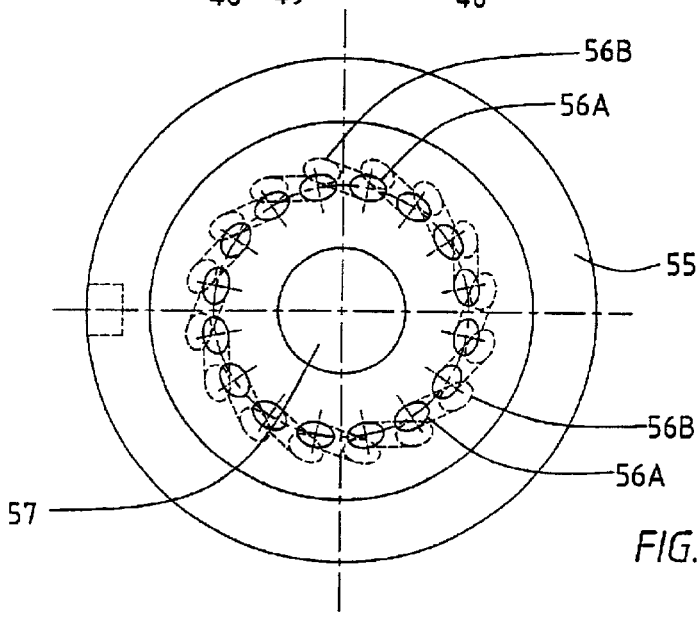
FIG. 5 shows a view of the bottom of the hollow casing in which the housing of the device is accommodated.

FIG. 5 shows a view from above of a very attractive preferred embodiment of a bottom 55 of a hollow casing in which a device according to the invention is accommodated.

The apertures 56 are drilled in such a way that the inlets 56A of the apertures 56 lie on a circle around the guide end 57, while the ends 56B thereof lie on another, in this case larger, circle. The outflow direction from the one or more apertures 56 (therefore the axis thereof) is here advantageously always situated in a tangent on a(n) (imaginary) conical surface. The apertures 56 are situated in this conical surface and the apex of the conical surface, and the apex of the conical surface is situated on the side at which the first medium is supplied, the outflow direction from each of the one or more apertures 56 forming an angle with a connecting line between the aperture 56 and the apex of the conical surface. It can be understood that the outflowing second medium flows out in an advantageous hollow cone, and also has a tangential component. Optimum atomization of the liquid product to be atomized can thus occur, even at relatively low pressures thereof.

Figure 6:
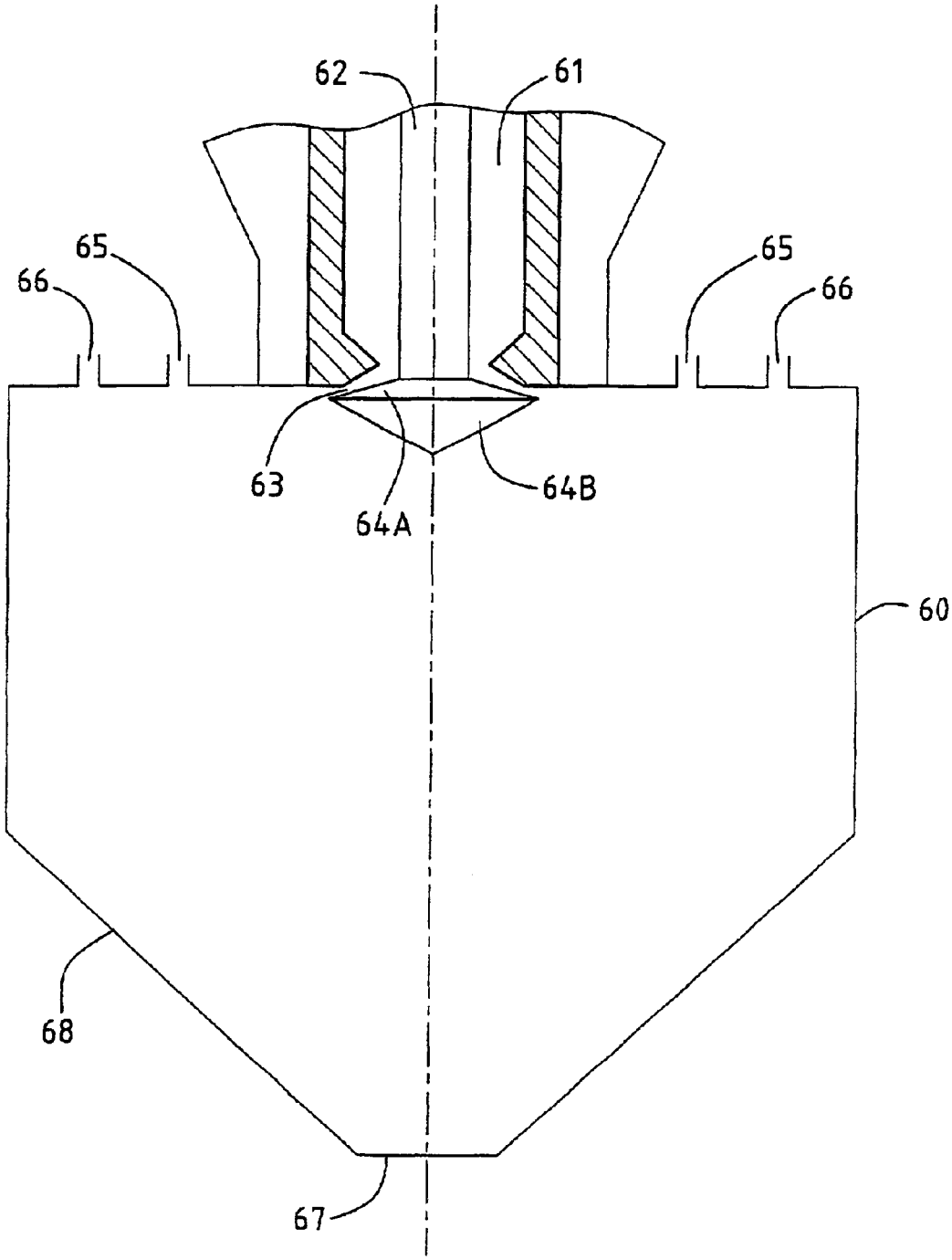
FIG. 6 shows schematically a device for heat-treating a product distributed in a liquid.

FIG. 6 shows an application of the device according to the invention which differs from the earlier mentioned spray-drying possibility. This application relates to heat treatment of a product distributed in a liquid, for example the boiling of starch in a paste thereof in water.

A starch paste for boiling is supplied by way of 61 and flows out in the form of a hollow liquid cone by way of the gap 63. Reference numerals 65 and 66 indicate that two other media can be supplied. For boiling starch, it will be sufficient to supply, for example, steam; for other products, steam and air, for example, are supplied. The starch paste flowing out by way of 63 in the form of a hollow cone is acted upon by the flow(s) of other medium out of 65 and/or 66, and the hollow cone breaks up into small droplets, while heating and mixing also occur. The heating occurs inside a built-on chamber 60; the treated product flows out at 67. An excellent boiled starch product can be prepared in this way in a very short time (residence times of the order of several tens of milliseconds).

Figure 7:
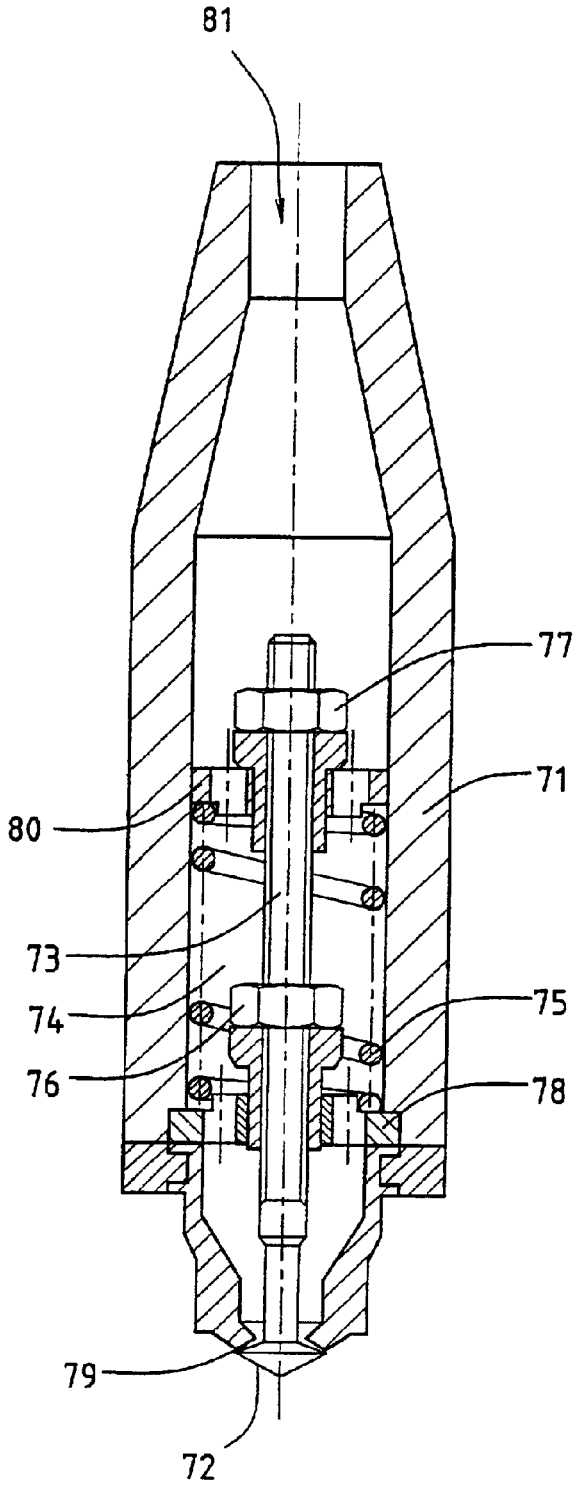
FIG. 7 shows a housing itself with an adjustably disposed insert piece.

Finally, FIG. 7 shows a housing which, as described above, can form part of a device according to the invention, but which also has independent inventive level. The functioning is as indicated in FIG. 4. The housing is indicated by 71, the movable, adjustable insert piece by 72, and the stem thereof by 73. The stem 73 is situated inside the space 74 and is surrounded by a spring 75.

As described in FIG. 4, nuts 76 and 77 are used to adjust the outflow gap setting or the opening/closing pressure with regard to the medium to be atomized, while 80 and 78 represent the movable and fixed stops so-called respectively for the spring means 75.

The medium for atomization enters at 81 and flows out through the outlet gap 79. If there is adequate pressure, the gap 79 opens to a value determined by the nut 76; when the pressure falls below that the gap closes again as a result of the spring force set by the nut 77.

With regard to the device according to the invention described here, which is equipped for atomizing a liquid medium, it is pointed out that said device has the following properties:

(a) the atomization is extremely fine and homogeneous;

(b) the spray cone in the form of a hollow cone is broken up very well into individual droplets by interaction with the one or more other media supplied by way of the apertures;

(c) the capacity of the nozzle is very easily adjustable and regulable between, for example, 100 and 1,000 kg per hour;

(d) the nozzle can operate at low liquid pressures, for example from 1.25 bar absolute.

The apex angle of the hollow liquid cone in general lies between 90° and 150°, and is preferably no less than 60°.

The apertures can lie at many different angles; a typical aperture lies at an angle of 45° relative to the normal to the bottom 8, the axis of a hole being a tangent on a conical surface whose apex angle is less than 90°, for example 70°. The channels expediently have a length of twice the aperture diameter, although it is also possible to deviate from this value.

What is claimed is:

1. Device for atomizing a liquid product, at least comprising a housing adapted to receive a first medium in the form of a liquid product for atomization, said housing having an outflow end and an insert piece with a guide end having a cone shape which interacts with the outflow end of the housing, thereby forming an annular outflow gap, wherein the housing is engaged in a hollow casing at a bottom thereof; and wherein one or more collections of apertures, each of said collections having of at least one aperture, are present in the bottom of the hollow casing, to which said at least one aperture at least one other medium is capable of being supplied, which medium can flow out of the aperture and interact with a hollow cone of liquid delivered through the outflow gap, and at least one of the collections of apertures being provided symmetrically around the housing, wherein axes of the apertures of the one or more collections of apertures are tangents on an imaginary conical surface, wherein the apex of the cone shape of the guide end is situated on a side of the housing from which the first medium is supplied and wherein the outflow gap is adjustable.

2. Device according to claim 1, wherein the cone shape of the guide end has an apex angle between 30 and 150 degrees.

3. Device according to claim 1, wherein the housing is of a circularly symmetric design, and each of the one or more collections of apertures is provided in a uniformly distributed manner on a circle around the housing.

4. Device according to claim 1, wherein the apertures are bores, and the axis of each of the bores forms an angle with a vertical to the bottom of the hollow casing.

5. Device according to claim 1, wherein in each of the one or more collections of apertures the apertures are combined to form a uniform gap.

6. Device according to claim 1, wherein the thickness H of the bottom of the hollow casing has the following relation with the diameter D and the angle α that an axis of an aperture forms with the horizontal of the bottom:

$$H \geq \frac{D}{\cos\alpha}.$$

* * * * *